US011073353B2

(12) United States Patent
Hendricks et al.

(10) Patent No.: US 11,073,353 B2
(45) Date of Patent: Jul. 27, 2021

(54) FIREARM WITH INTERCHANGEABLE THREADED AND NON-THREADED BARREL—RECEIVER CONNECTION

(71) Applicant: BLACKPOWDER PRODUCTS, INC., Lawrenceville, GA (US)

(72) Inventors: Mark D. Hendricks, Duluth, GA (US); George A. Hawthorn, Kalispell, MT (US)

(73) Assignee: BLACKPOWDER PRODUCTS, INC., Lawrenceville, GA (US)

( * ) Notice: Subject to any disclaimer, the term of this patent is extended or adjusted under 35 U.S.C. 154(b) by 42 days.

(21) Appl. No.: 16/390,395

(22) Filed: Apr. 22, 2019

(65) Prior Publication Data

US 2020/0333097 A1 Oct. 22, 2020

(51) Int. Cl.
*F41A 21/48* (2006.01)

(52) U.S. Cl.
CPC ..... *F41A 21/485* (2013.01); *F41A 21/482* (2013.01); *F41A 21/487* (2013.01)

(58) Field of Classification Search
CPC ..... F41A 21/48; F41A 21/481; F41A 21/482; F41A 21/485; F41A 21/488; F41A 21/487; F41A 3/66
See application file for complete search history.

(56) References Cited

U.S. PATENT DOCUMENTS

| | | | | |
|---|---|---|---|---|
| 1,494,524 | A * | 5/1924 | Adamson | F41A 21/00 89/16 |
| 4,674,217 | A * | 6/1987 | Matievich | F41A 21/482 42/75.02 |
| 7,823,314 | B1 * | 11/2010 | Wheatley | F41A 21/484 42/75.02 |
| 2015/0369555 | A1 * | 12/2015 | Daniel | F41C 23/16 42/75.02 |
| 2017/0356708 | A1 * | 12/2017 | Michael | F41A 9/70 |

FOREIGN PATENT DOCUMENTS

| | | | |
|---|---|---|---|
| FR | 622601 | * | 6/1927 |

* cited by examiner

*Primary Examiner* — Joshua T Semick
(74) *Attorney, Agent, or Firm* — Gardner Groff & Greenwald, PC

(57) ABSTRACT

A firearm having a threaded barrel-receiver connection, with a threaded receiver opening for cooperative engagement with a threaded barrel. The receiver is also compatible with a clamping system for engagement of an unthreaded barrel, so that threaded and unthreaded barrels may be used interchangeably. The threads of the receiver may have a flat crested thread profile for sliding engagement upon installation of an unthreaded barrel.

22 Claims, 5 Drawing Sheets

FIREARM WITH INTERCHANGEABLE THREADED AND NON-THREADED BARREL—RECEIVER CONNECTION

TECHNICAL FIELD

The present invention relates generally to the field of firearms and firearm accessories, and more particularly to a firearm having a receiver capable of interchangeably accepting a threaded or a non-threaded barrel.

BACKGROUND

Firearms of various types may include a non-threaded barrel connection, wherein the breech end of the barrel is engaged with a close sliding, location, transition, or interference fit into the receiver. For example, the Ruger 10/22, one of the most popular rimfire rifles, typically has an unthreaded connection between the barrel and the receiver, with a barrel clamp system configured to maintain the barrel-receiver connection. The unthreaded barrel-receiver connection, however, may allow some degree of play or movement between components, even when the barrel clamp system is properly engaged, potentially causing shooting accuracy to suffer.

The popularity of such firearms has led to the production of many aftermarket accessories, such as high precision barrels for improved accuracy or specialized barrels for particular purposes. Some shooters, for example, may purchase multiple barrels for interchangeable use with their firearm's receiver for different types of shooting, for example a shorter and lighter barrel for hunting and a longer and heavier barrel for target shooting. And even if they purchase a new firearm, shooters may still wish to use a previously purchased barrel with their new firearm.

SUMMARY

In example embodiments, the present invention provides a firearm having a threaded barrel-receiver connection, which is also interchangeable for retrofit use with an unthreaded firearm barrel. In this manner, improved accuracy may be provided by the threaded barrel-receiver connection. And if a user desires to use a previously purchased unthreaded barrel, the threaded barrel can be removed, and the receiver will accept the unthreaded barrel and allow interchangeable connection.

In one aspect, the present invention relates to a firearm including a receiver having a threaded receiver opening and at least one barrel clamp bore. The firearm preferably also includes a threaded barrel having a threaded hub configured for threaded engagement within the threaded receiver opening of the receiver.

In another aspect, the invention relates to a firearm including a receiver having a threaded receiver opening, the threaded receiver opening having female threads with a flat crested thread profile. The firearm preferably also includes a threaded barrel having male threads with a barrel thread profile configured for cooperative engagement with the flat crested receiver thread profile.

In still another aspect, the invention relates to a firearm including a receiver having a threaded receiver opening and at least one barrel clamp bore. The threaded receiver opening preferably includes female threads having a flat crested thread profile. The firearm preferably also includes a threaded barrel having male threads with a barrel thread profile configured for cooperative engagement with the flat crested receiver thread profile. The firearm preferably also includes a clamping system having a clamping member and at least one clamping screw configured for cooperative engagement with the at least one barrel clamp bore of the receiver. In this manner an unthreaded barrel can be interchangeably installed in place of the threaded barrel.

In another aspect, the invention relates to a firearm barrel including an elongate barrel portion having a bore extending therethrough, and a threaded hub for removable engagement with a corresponding threaded receiver opening of a firearm, the threaded hub having threads with a flat or rounded crest and root thread profile, such as for example an Acme or square thread profile.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
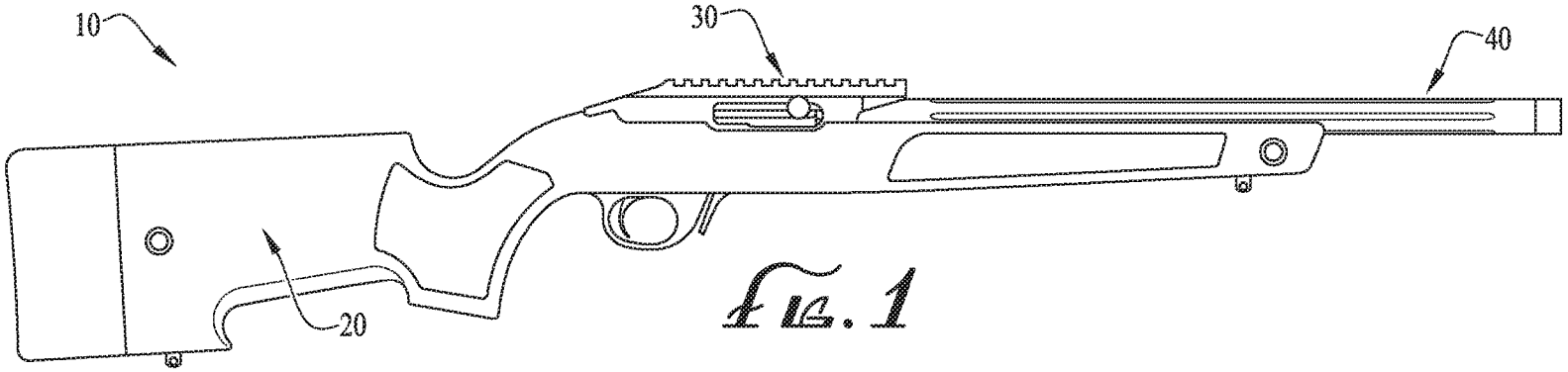
FIG. 1 is shows a firearm according to an example embodiment of the present invention.

With reference now to the drawing figures, wherein like reference numbers represent corresponding parts throughout the several views, FIGS. 1-4 show a firearm 10 according to an example form of the invention, in standard and retrofit configurations. FIG. 1 shows the firearm 10, generally comprising a stock 20, a receiver 30, and a barrel 40. The firearm further comprises a trigger mechanism, and optionally comprises a cartridge magazine, feed and extraction action mechanisms, sights, scope mount, and/or other features in typical fashion. In the depicted example embodiment, the firearm 10 is in the form of a rifle, for example a .22 caliber rimfire semiautomatic carbine. In alternate example embodiments, the firearm may take the form of a rifle, a pistol, a shotgun or other firearm formats; may be chambered for rimfire or centerfire cartridges of different calibers, and/or may be configured as a breech-loading or muzzle-loading firearm, with the barrel 40 configured for removable attachment to and from the receiver 30. In particular embodiments, the firearm 10 optionally includes one or more components configured for compatibility with a pre-existing firearm format, such as for example the barrel clamp components of a Ruger 10/22 firearm format.

Figure 2A:
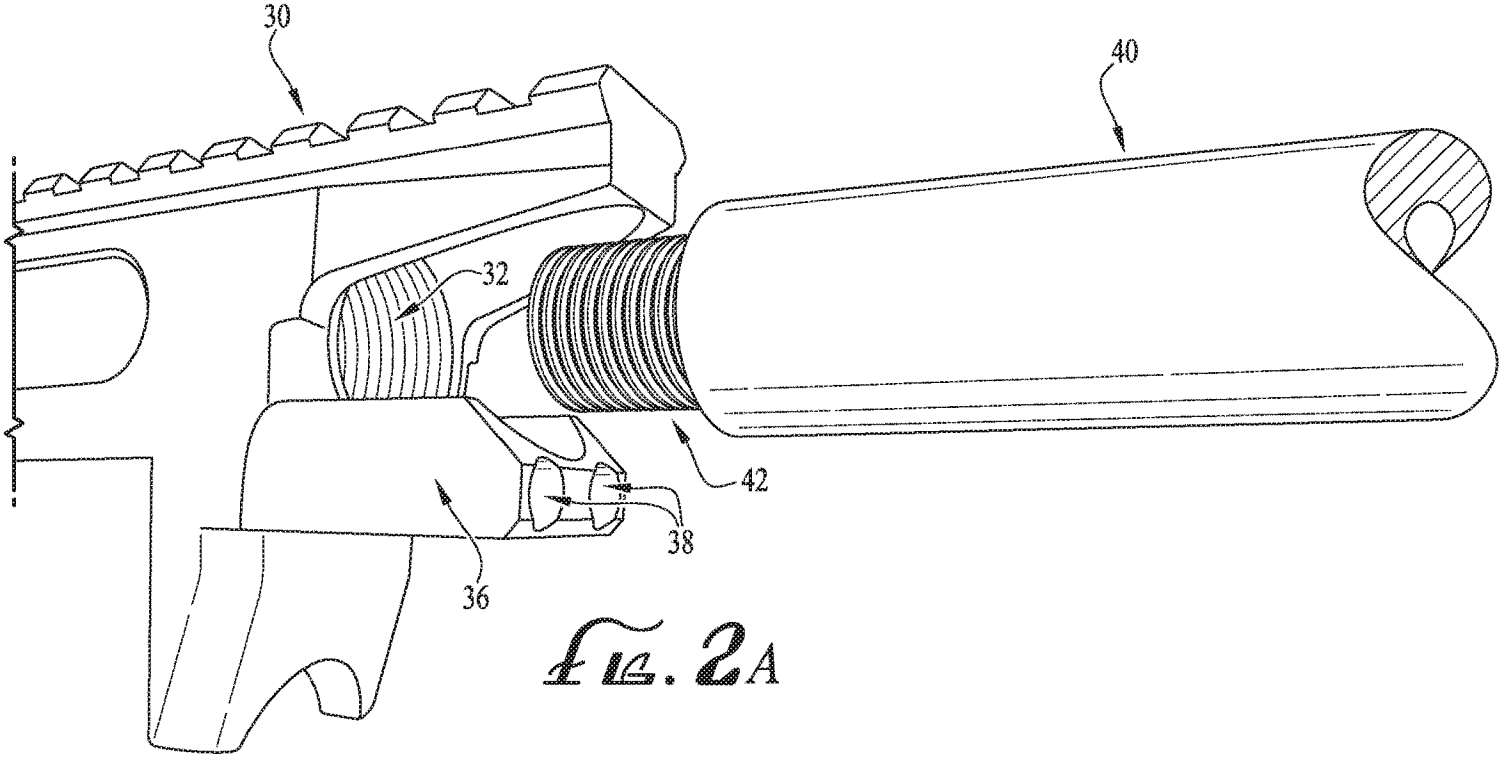
FIG. 2A is a perspective view of a threaded barrel-receiver connection of a firearm according to an example embodiment of the present invention.
Figure 2B:
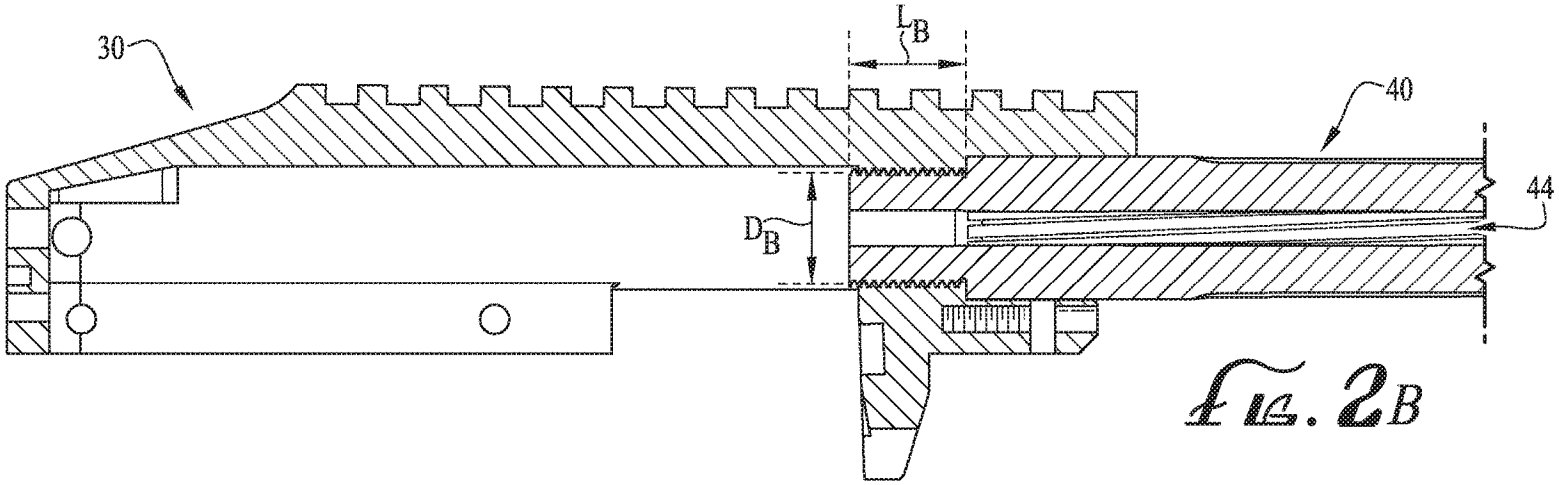
FIG. 2B is a cross-sectional side view of the threaded barrel-receiver connection of FIG. 2A, with the barrel engaged with the receiver.
Figure 2C:
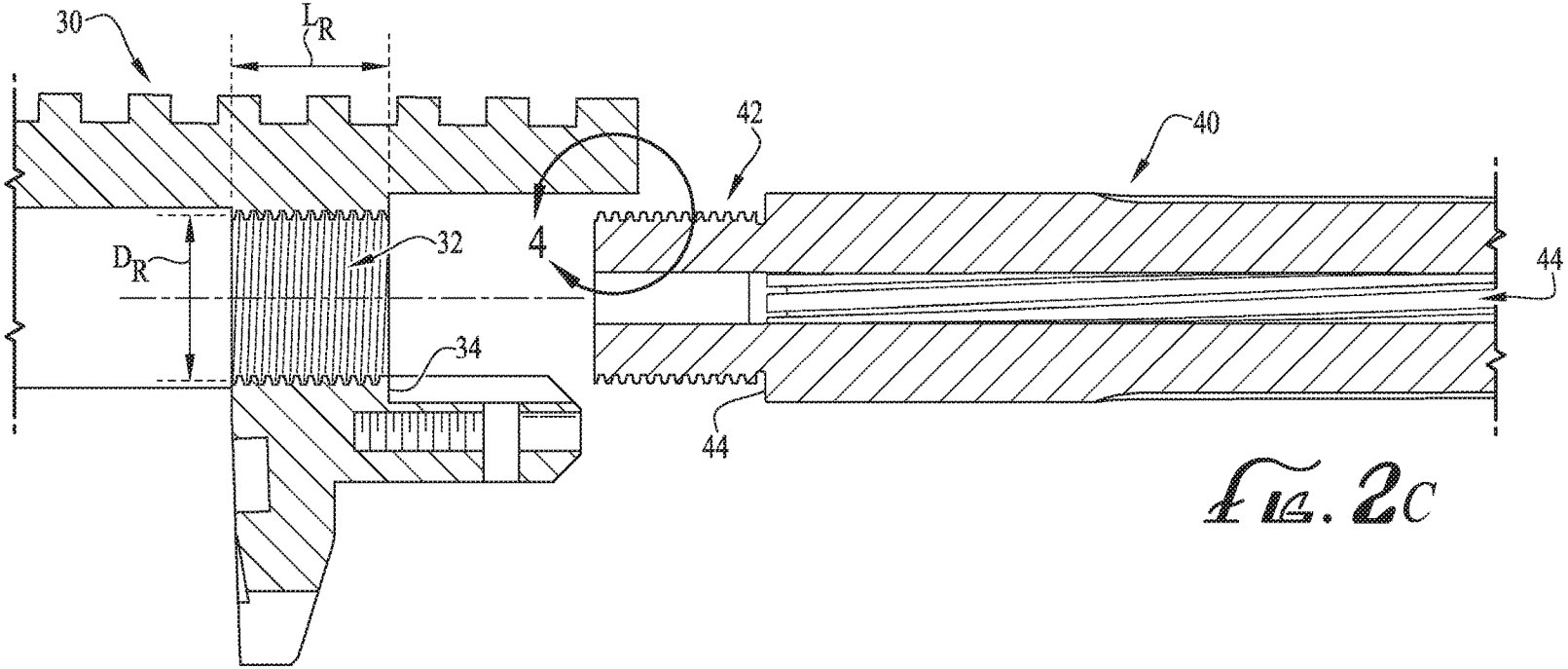
FIG. 2C is a cross-sectional side view of the threaded barrel-receiver connection of FIG. 2A, with the barrel detached from the receiver.

FIGS. 2A-2C show details of the threaded barrel-receiver connection of the firearm 10. The receiver 30 comprises a generally cylindrical female threaded receiver opening 32, configured to cooperatively receive and engage a generally cylindrical male threaded hub 42 of the standard or original equipment barrel 40, in a typical rotationally threaded coupling engagement. The receiver 30 optionally comprises stepped bore configuration formed by a flange or rim 34 around the proximal end of the receiver opening 32, against which a shoulder or abutment face 44 around the distal end of the threaded hub 42 of the barrel 40 seats or abuts when the barrel is fully engaged within the receiver as shown in FIG. 2B. In example embodiments, the female threaded receiver opening 32 has a nominal inside diameter $D_R$ of 0.6910" and a length $L_R$ of 0.6898", and the male threaded hub 42 has a nominal outside diameter $D_B$ of 0.7485" and a length $L_B$ of 0.7244". In alternate embodiments, the female threaded receiver opening 32 and the male threaded hub 42 may be otherwise dimensioned and configured depending on the intended application or for compatibility with a desired firearm format. The receiver 30 further comprises a lower engagement portion 36 having one or more (a pair are depicted) threaded barrel clamp bores 38 formed therein, for engagement with a barrel clamp system in a retrofit configuration, as described below. The barrel 40 further comprises a rifled (depicted) or smooth bore extending axially through its length, and optionally includes a cylindrical or tubular outer surface, aiming sights and other features in standard fashion.

Figure 4:
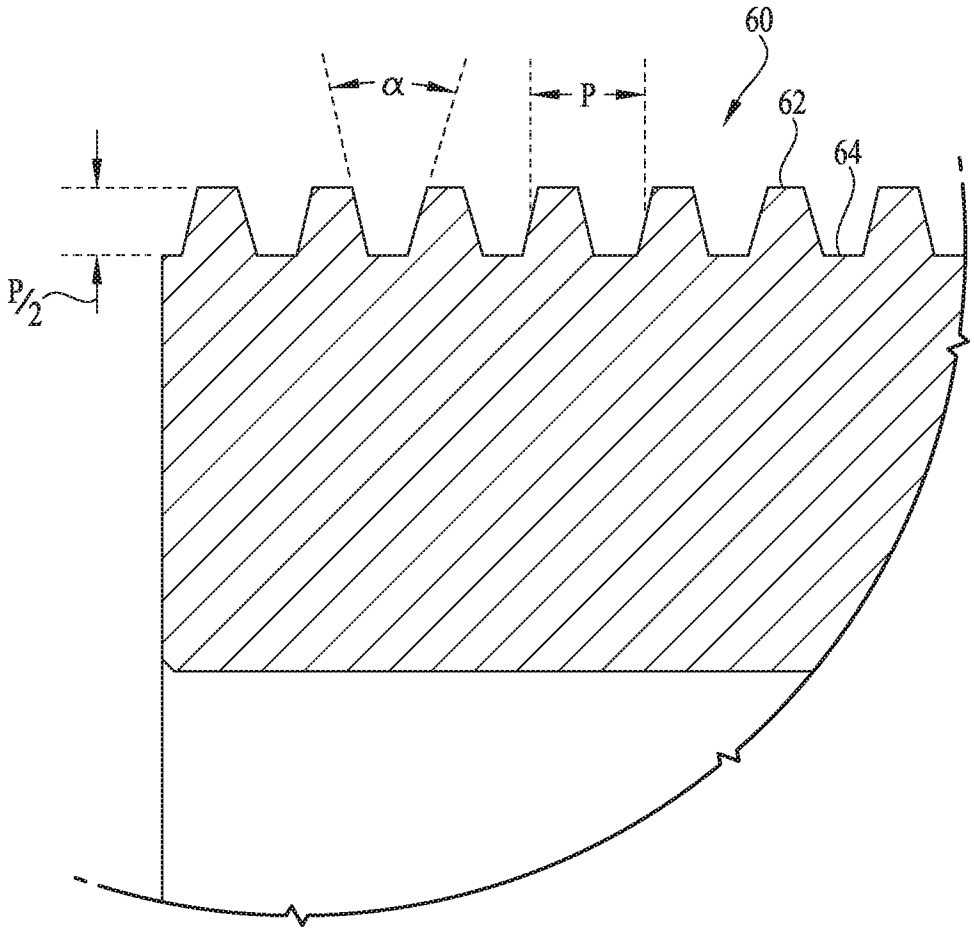
FIG. 4 is a detailed view of a section of barrel-receiver connection threads, according to an example embodiment of the invention.

In example embodiments, and as shown in greater detail in FIG. 4, the threads 60 of either or both of the female threaded receiver opening 32 and the male threaded hub 42 comprise trapezoidal or square thread forms, for example an Acme thread form, having flat crest/apex and root/valley surfaces, 62, 64 oriented parallel to the longitudinal central axis of the barrel-receiver connection. In example forms, the threads 60 define a thread angle $\alpha$ of about 29°, a thread pitch P of about 0.0625", and a thread height P/2 of about one-half the thread pitch P or about 0.0313". In addition, for this example the Major Ø Min (minimum major diameter), Major Ø Max (maximum major diameter), Pitch Ø Min (minimum pitch diameter), Pitch Ø Max (maximum pitch diameter), Minor Ø Min (minimum minor diameter), Minor Ø Max (maximum minor diameter), Fcn (crest truncation) and Frn (root truncation) are 0.7610", 0.7710", 0.7198", 0.7257", 0.6885", 0.6935", 0.0232" and 0.0206" respectively. In example embodiments, the thread tooth shape or profile has a base wider than its crest. In alternate embodiments, other thread profiles such as for example, other trapezoidal thread geometries, square, modified square, buttress, modified buttress, worm, Whitworth, stub, knuckle, stub Acme, American National (unified), B&S worm, Dardelet, or other thread profiles having a flat or rounded crest/apex and root/valley surface profile may be utilized on either or both of the female threaded receiver opening and the male threaded hub. In still further embodiments, a sharp V or straight thread profile may be utilized on either or both of the female threaded receiver opening and the male threaded hub.

Figure 3A:
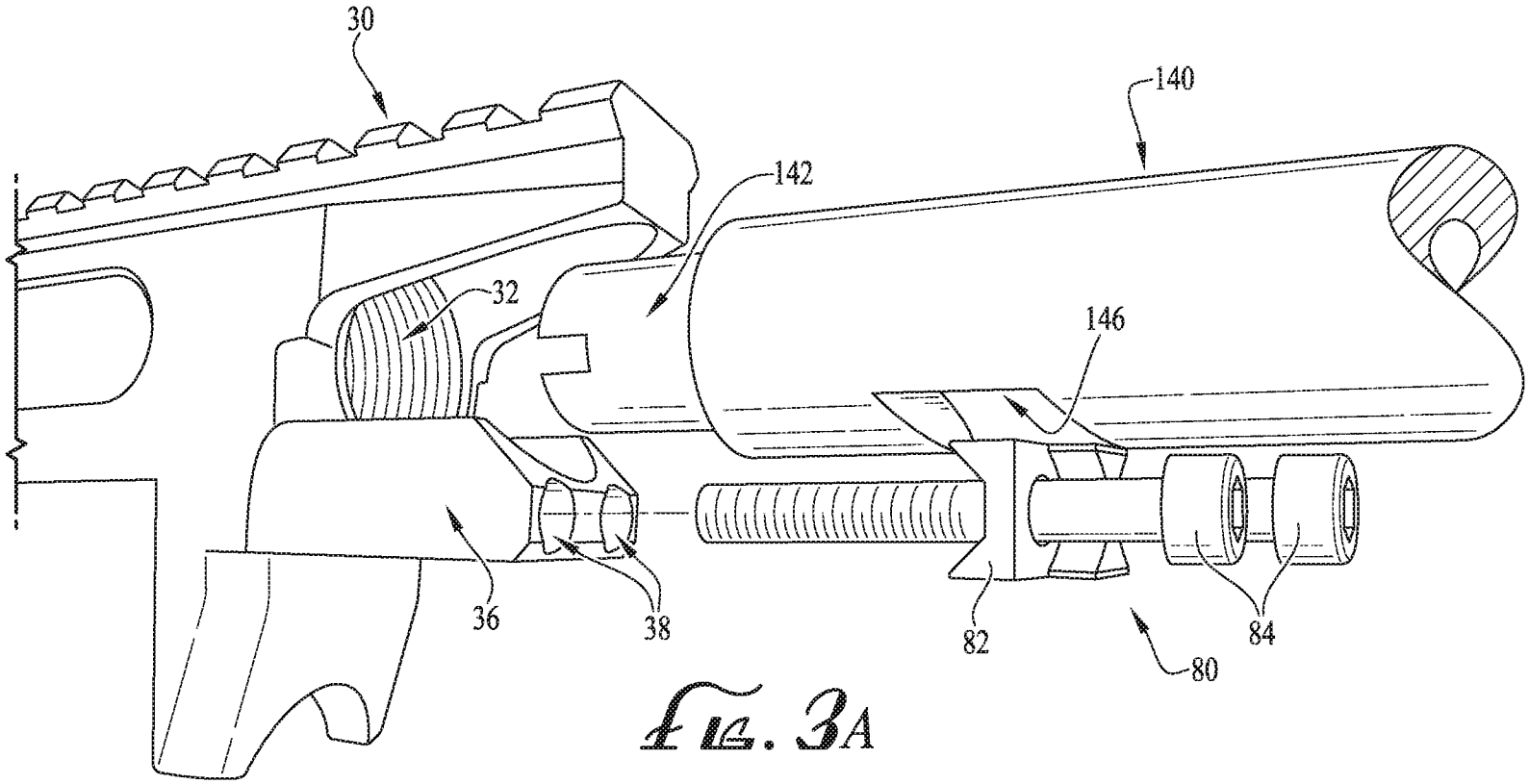
FIG. 3A is a perspective view of a barrel-receiver connection of a firearm according to an example embodiment of the present invention, with an unthreaded barrel configured for retrofit installation into the threaded receiver.
Figure 3B:
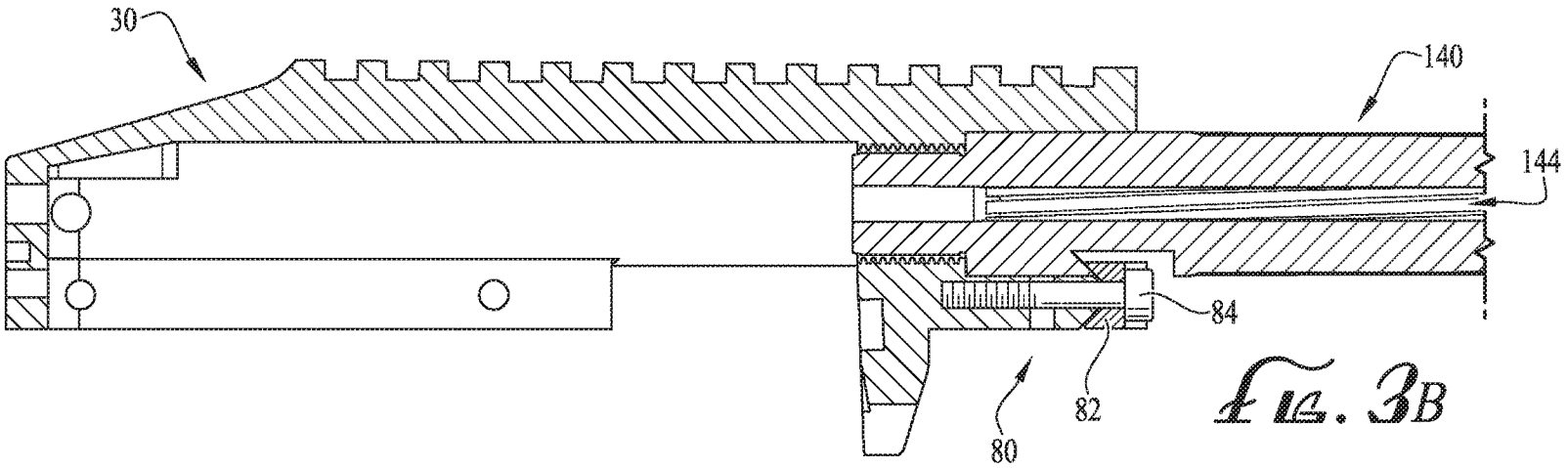
FIG. 3B is a cross-sectional side view of the unthreaded barrel-threaded receiver connection of FIG. 3A, with the barrel engaged with the receiver and a barrel clamp system engaged.
Figure 3C:
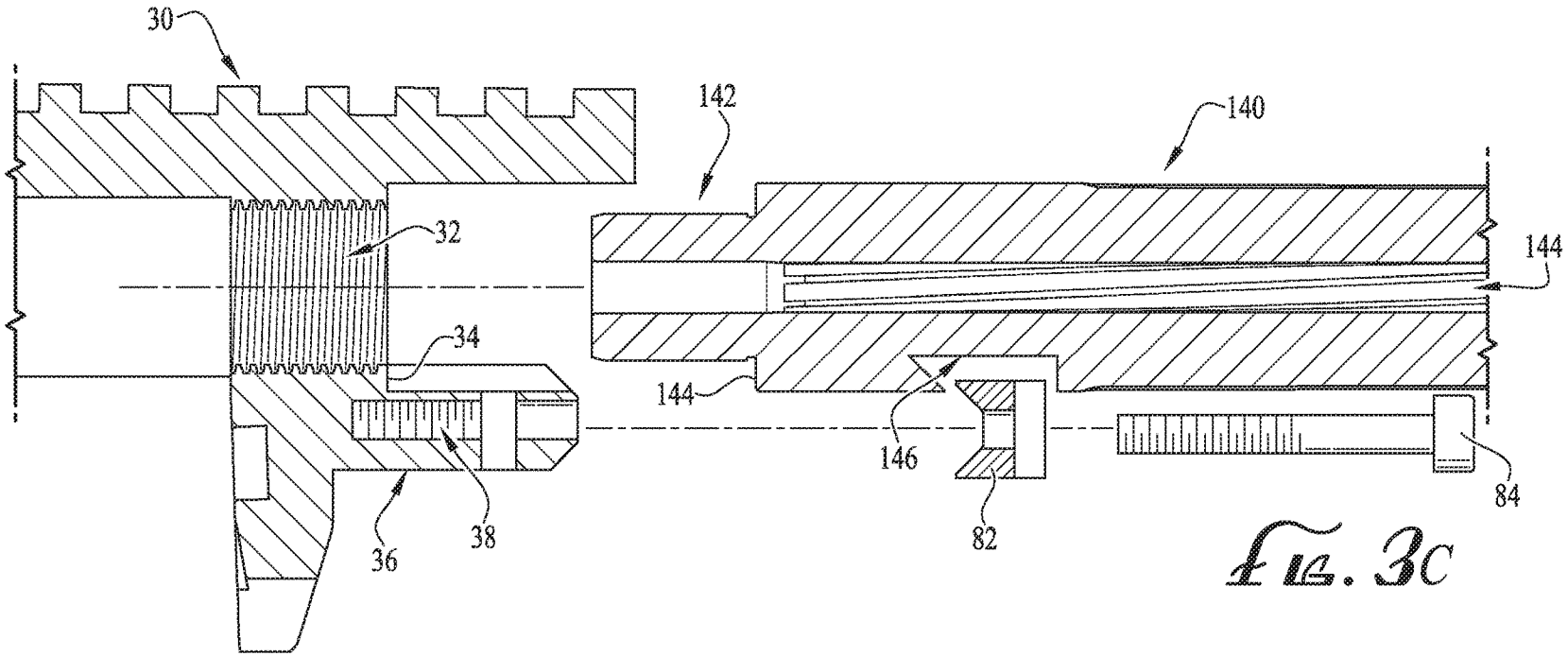
FIG. 3C is a cross-sectional side view of unthreaded barrel-threaded receiver connection of FIG. 3A, with the barrel detached from the receiver and the barrel clamp system disengaged.

FIGS. 3A-3C show a retrofit or change-out configuration, wherein the threaded receiver 30 of the firearm 10 interchangeably receives and engages an unthreaded retrofit barrel 140. The barrel 140 includes a generally cylindrical unthreaded male mounting hub 142 configured to be slidingly received within the threaded female bore 32 of the receiver 30 with a close clearance (sliding or location fit), transition or light interference fit. A shoulder or abutment face 144 around the distal end of the threaded hub 142 of the barrel 140 seats or abuts against the flange or rim 34 around the proximal end of the receiver opening 32 of the receiver 30 when the barrel is fully engaged within the receiver as shown in FIG. 3B. The barrel 140 further comprises a rifled or smooth bore 144, and a clamp-engagement cutout 146.

A barrel clamp system 80 is provided for connection of the unthreaded retrofit barrel 140 with the threaded receiver 30 of the firearm 10 in the retrofit or change-out configuration. The barrel clamp system 80 includes a clamping member 82, and one or more (two are depicted) clamping screws or bolts 84. In example embodiments, the clamping member 82 comprises a female dovetailed profile having opposed inwardly tapering, acutely-angled engagement surfaces, configured to positively engage the clamp-engagement cutout 146 of the retrofit barrel 140, and align with a correspondingly configured cooperating male dovetailed profile of the lower engagement portion 36 of the receiver 30. The clamping screw(s) 84 are inserted through clearance holes or bores in the clamping member, and into threaded engagement within the barrel clamp bores 38 in the lower engagement portion 36 of the receiver 30. Tightening the clamping screws 84 pulls the male mounting hub 142 of the barrel 140 into engagement within the bore 32 of the receiver 30, with the clamping member positively engaged in the clamp-engagement cutout 146 to securely retain the retrofit barrel 140 in the receiver 30 as shown in FIG. 3B.

In use, the firearm 10 will typically be provided with a threaded barrel 40 installed as original equipment, with the threaded barrel securely screwed into the threaded receiver 30 (FIGS. 2A-2C). The threaded coupling connecting the threaded barrel 40 in engagement with the receiver 30 independently provides solid engagement and secure positioning for precise shooting accuracy in use with the threaded barrel. The use of a separate barrel clamping system or attachment means other than the threaded barrel-receiver coupling will typically not be necessary in this configuration.

If and when desired, a user may remove the threaded barrel 40 by unscrewing it from the receiver to disengage the threaded hub 42 from the threaded receiver opening 32, and may install the threaded barrel by screwing it into the receiver to engage the threaded hub into the receiver opening. The threaded connection may be hand-tight, allowing for manual removal and installation without the need for tools, or a wrench or other tool may be provided for removal and installation of the threaded barrel 40.

After removal of the threaded barrel 40, an unthreaded retrofit barrel 140 can then be interchangeably installed in place of the threaded barrel. The retrofit barrel 140 is installed by sliding the unthreaded hub 142 of the barrel into the threaded receiver opening 32 of the receiver 30. The outside diameter of the unthreaded hub 142 is configured to be slidingly received within the threaded receiver opening 32. The provision of threads 60 in the threaded receiver opening 32 having a flat or rounded crest/apex surface thread profile, for example an Acme or other trapezoidal or square thread profile, will provide an improved sliding fit and more secure coupling engagement with the barrel hub 142 than a sharp V-shaped thread configuration, and reduce the likelihood of damaging the threads of the receiver opening upon installation of the unthreaded barrel hub. The barrel clamping system 80 is then engaged by installation of the clamping member 82 into the clamp-engagement cutout 146 of the retrofit barrel 140, inserting the clamping screw(s) 84 through the clamping member, and screwing the clamping screws into threaded engagement with the barrel clamp bores 38 in the lower engagement portion 36 of the receiver 30. Tightening the clamping screws 84, for example with an Allen wrench or screwdriver, securely couples the barrel 140 with the receiver 30, allowing the firearm to be used with the retrofit barrel.

The unthreaded retrofit barrel 140 can be removed by disengaging the clamping system 80 in reverse manner, and slidingly removing the barrel from the receiver. The user may then interchangeably reinstall the threaded original equipment barrel 40 back in its place, as desired by the user, for example for different shooting activities or for comparing barrel performance. For example, two or more interchangeable barrels of different lengths, weights, rifling twists, sight configurations, accessory features, materials of construction, coupling formats, and/or other differing configurations or features may be installed and removed for use with the firearm, as desired by the user.

While the invention has been described with reference to example embodiments, it will be understood by those skilled in the art that a variety of modifications, additions and deletions are within the scope of the invention, as defined by the following claims.

What is claimed is:

1. A firearm comprising:

a receiver comprising a threaded receiver opening and at least one barrel clamp bore; and a threaded barrel comprising a threaded hub integrally formed with the barrel and configured for threaded engagement directly within the threaded receiver opening of the receiver and without engagement of the at least one barrel clamp bore;

and wherein the threaded receiver opening of the receiver comprises threads having flat thread crest surfaces whereby the receiver is configured for interchangeable compatibility with an unthreaded barrel having an unthreaded mounting hub configured for sliding engagement along the flat thread crest surfaces and into the threaded receiver opening.

2. The firearm of claim 1, further comprising a clamping member and at least one clamping screw configured for cooperative engagement with the at least one barrel clamp bore of the receiver, whereby the unthreaded barrel can be interchangeably installed in place of the threaded barrel.

3. The firearm of claim 1, wherein the threaded receiver opening and the threaded hub comprise interengaging threads having a flat crest and root thread profile.

4. The firearm of claim 1, wherein the threaded receiver opening and the threaded hub comprise interengaging threads having a trapezoidal thread profile.

5. The firearm of claim 1, wherein the threaded receiver opening and the threaded hub comprise interengaging threads having an Acme thread profile.

6. The firearm of claim 1, further comprising a stock to which the barrel and the receiver are mounted in a rifle configuration.

7. The firearm of claim 1, wherein the firearm is a .22 caliber rimfire firearm.

8. The firearm of claim 1, wherein the threaded receiver opening and the at least one barrel clamp bore are configured for compatibility with a Ruger 10/22 format unthreaded barrel.

9. A firearm comprising:

a receiver comprising a threaded receiver opening, the threaded receiver opening comprising female threads having a flat crested thread profile; and a threaded barrel comprising male threads for threaded engagement directly within the threaded receiver opening of the receiver, the male threads having a barrel thread profile configured for cooperative threaded engagement with the flat crested receiver thread profile; and the flat crested thread profile of the female threads of the threaded receiver opening being configured for sliding engagement with an unthreaded barrel.

10. The firearm of claim 9, wherein the receiver further comprises at least one barrel clamp bore configured for cooperative engagement with a clamping system for engagement of the unthreaded barrel.

11. The firearm of claim 10, wherein the clamping system comprises a clamping member and at least one clamping screw configured for cooperative engagement with the at least one barrel clamp bore of the receiver, whereby the unthreaded barrel can be interchangeably installed in place of the threaded barrel.

12. The firearm of claim 11, wherein the clamping system is configured for compatibility with a Ruger 10/22 format unthreaded barrel.

13. The firearm of claim 9, wherein the female threads of the threaded receiver opening comprise a trapezoidal thread profile.

14. The firearm of claim 13, wherein the trapezoidal thread profile comprises an Acme thread profile.

15. The firearm of claim 9, further comprising a stock to which the barrel and receiver are mounted in a rifle configuration.

16. The firearm of claim 9, wherein the firearm is a .22 caliber rimfire firearm.

17. A firearm comprising:

a receiver comprising a threaded receiver opening and at least one barrel clamp bore, the threaded receiver opening comprising female threads having a flat crested thread profile;

a threaded barrel comprising a threaded mounting hub having male threads configured for direct threaded engagement within the threaded receiver opening, the male threads having a barrel thread profile configured for cooperative threaded engagement with the flat crested receiver thread profile; and a clamping system comprising a clamping member and at least one clamping screw configured for cooperative engagement with the at least one barrel clamp bore of the receiver, whereby an unthreaded barrel can be interchangeably installed in place of the threaded barrel with the flat crested thread profile of the female threads of the threaded receiver opening being configured for sliding engagement with an unthreaded mounting hub of the unthreaded barrel, and the clamping member configured for engagement by the at least one clamping screw against the unthreaded barrel to retain the unthreaded barrel in place in the receiver.

18. The firearm of claim 17, wherein the clamping system is configured for compatibility with a Ruger 10/22 format unthreaded barrel.

19. The firearm of claim 17, wherein the female threads of the threaded receiver opening comprise a trapezoidal thread profile.

20. The firearm of claim 19, wherein the trapezoidal thread profile comprises an Acme thread profile.

21. The firearm of claim 17, further comprising a stock to which the barrel and the receiver are mounted in a rifle configuration.

22. The firearm of claim 17, wherein the firearm is a .22 caliber rimfire firearm.

* * * * *